US005101238A

United States Patent [19]

Creveling et al.

[11] Patent Number: 5,101,238

[45] Date of Patent: Mar. 31, 1992

[54] ROLLER TRANSFER ASSEMBLY

[75] Inventors: Clyde M. Creveling; Victor C. Solomon; Carla A. Rauschenplat; Lynn W. Arnold, all of Rochester, N.Y.

[73] Assignee: Eastman Kodak Company, Rochester, N.Y.

[21] Appl. No.: 643,594

[22] Filed: Jan. 18, 1991

[51] Int. Cl.[5] ..... G03G 15/16

[52] U.S. Cl. ..... 355/271; 355/274; 355/315

[58] Field of Search ..... 355/219, 221, 215, 271, 355/274, 315

[56] References Cited

U.S. PATENT DOCUMENTS

| | | | |
|---|---|---|---|
| 3,847,119 | 11/1974 | Hoffman et al. | 118/652 |
| 3,894,799 | 7/1975 | Prats | 355/246 |
| 3,907,421 | 9/1975 | Jordan et al. | 355/271 |
| 4,190,348 | 2/1980 | Friday | 355/274 |

*Primary Examiner*—Joan H. Pendegrass

*Attorney, Agent, or Firm*—Lawrence P. Kessler

[57] ABSTRACT

For use in an electrostatographic reproduction apparatus, a roller transfer assembly of compact configuration for effecting transfer of a pigmented marking particle image from a dielectric support to a receiver member. The roller transfer assembly comprises an electrically biased transfer roller, a mechanism for cleaning the transfer roller, and a detack mechanism for facilitating release of the receiver member from the dielectric support. A unitary housing is provided for supporting the transfer roller for free rotation about its longitudinal axis, supporting the cleaning mechanism in operative association with the transfer roller, and for supporting the detack mechanism. The unitary housing is supported for movement to a first position in operative association with the dielectric support and a second inoperative position remote from the dielectric support, and a mechanism is provided for selectively moving the unitary housing to the first position or to the second position.

27 Claims, 6 Drawing Sheets

ROLLER TRANSFER ASSEMBLY

BACKGROUND OF THE INVENTION

This invention relates in general to transfer assembly for use for example in an electrostatographic reproduction apparatus, and more specifically to a roller transfer assembly which is readily movable to an operative or inoperative position within the reproduction apparatus.

In modern high speed/high quality electrostatographic reproduction apparatus (copier/duplicators or printers), a latent image charge pattern is formed on a uniformly charged dielectric support member. Pigmented marking particles are attracted to the latent image charge pattern to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member while in contact with the dielectric support, or by an electrically biased roller urging the receiver member against the dielectric support. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support is remarkedly efficient in providing intimate uniform contact therebetween. However, roller transfer apparatus are more complex than corona transfer apparatus in that they require cleaning due to their tendency to pick up marking particles from the dielectric support and undesirably deposit such particles on the back side of the receiver member. Further, the roller transfer apparatus, including their cleaning assemblies must be constructed so as not to interfere with ready clearance of any jammed receiver members.

SUMMARY OF THE INVENTION

This invention is directed to a roller transfer assembly, for use in an electrostatographic reproduction apparatus, which transfer assembly is of a unique compact construction so as to provide efficient marking particle transfer, efficient transfer roller cleaning, and ready movement to its operative position or an inoperative position for jam clearance or changing of the dielectric support. The roller transfer assembly comprises an electrically biased transfer roller, a mechanism for cleaning the transfer roller, and a detack mechanism for facilitating release of the receiver member from the dielectric support. A unitary housing is provided for supporting the transfer roller for free rotation about its longitudinal axis, supporting the cleaning mechanism in operative association with the transfer roller, and for supporting the detack mechanism. The unitary housing is supported for movement to a first position in operative association with the dielectric support and a second inoperative position remote from the dielectric support, and a mechanism is provided for selectively moving the unitary housing to the first position or to the second position.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
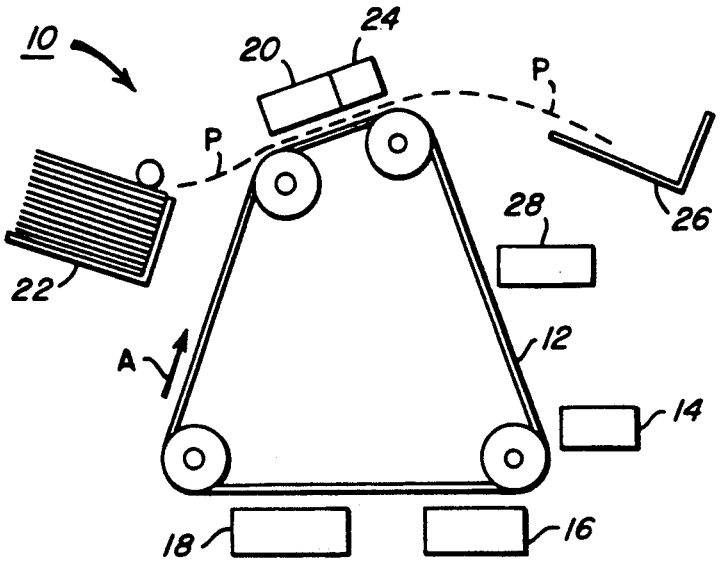
FIG. 1 is a schematic illustration of a typical electrostatographic reproduction apparatus suitable for utilizing the roller transfer assembly according to this invention.

Referring now to the accompanying drawings, FIG. 1 shows schematically illustrates a typical electrostatographic reproduction apparatus 10 suitable for utilizing the roller transfer assembly according to this invention. The reproduction apparatus 10, described herein only to the extent necessary for a complete understanding of this invention, includes a dielectric support 12. The dielectric support 12 is, for example, in the form of an endless web mounted on support rollers and movable about a closed loop path in the direction of arrow A through a series of electrographic process stations.

In the reproduction cycle for the reproduction apparatus 10, the moving dielectric support 12 is uniformly charged as it moves past a charging station 14. Thereafter the uniformly charged dielectric support passes through an exposure station 16 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support to a reflected light image of an original document to be reproduced or "writing" on the dielectric support with a series of lamps (e.g., LED's or lasers) or point electrodes activated by electronically generated signals based on the desired information to be reproduced. The latent image charge pattern on the dielectric support 12 is the brought into association with a development station 18 which applies pigmented marking particles to adhere to the dielectric support to develop the latent image. The portion of the dielectric support carrying the developed image then passes through a transfer station 20 in register with a receiver member fed in proper timed relation from a supply hopper 22 along the path P. An electric field produced in the transfer station attracts the marking particle of the developed image from the dielectric support to the receiver member.

The electric transfer field may also cause the receiver member to adhere to the dielectric support. Accordingly, a detack mechanism 24, immediately downstream in the direction of travel of the dielectric support, is provided to facilitate removal of the receiver member from the dielectric support. The detack mechanism may be, for example, an AC corona charger for neutralizing the attractive field holding the receiver member to the dielectric support. After the developed image is transferred to the receiver member and the receiver member is separated from the dielectric support, the receiver member is transported through a fusing device 26 where the image is fixed to the receiver member by heat and/or pressure for example, and delivered to an output hopper 28 for operator retrieval. Simultaneously, the dielectric support 12 is cleaned of any residual marking particles at cleaning station 30 and returned to the charging station 14 for reuse.

Figure 2:
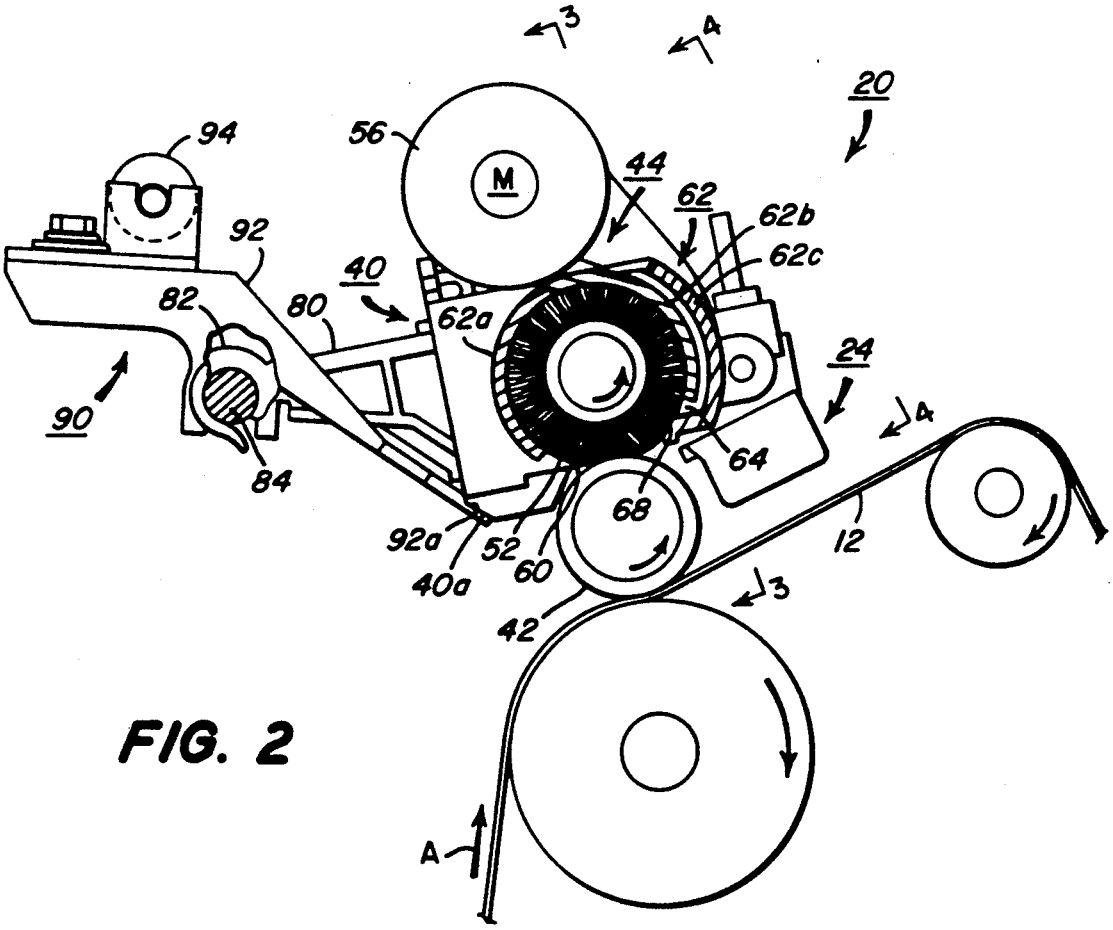
FIG. 2 is a front elevational view, partly in cross-section, of the roller transfer assembly according to this invention.
Figure 4:
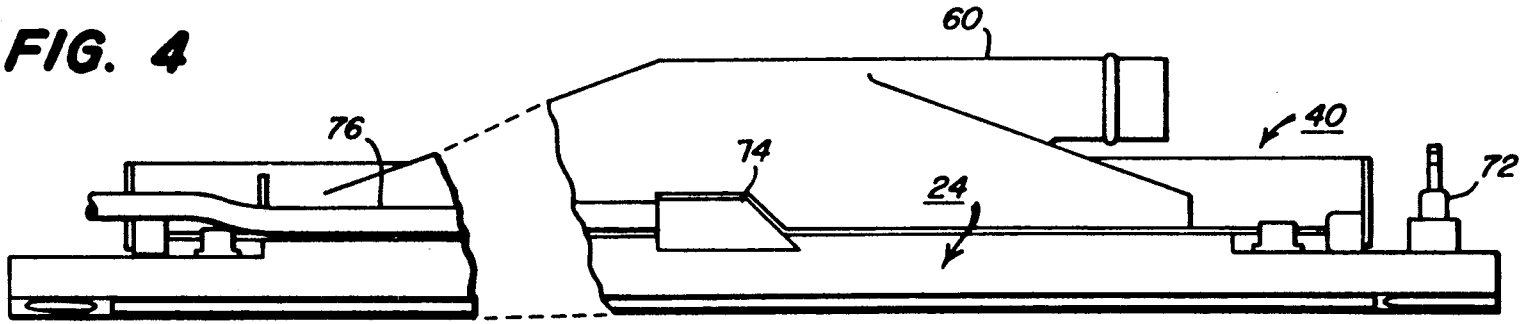
FIG. 4 is a side elevational view, partly in cross-section and with portions removed, of the roller transfer assembly taken along lines 4—4 of FIG. 2.
Figure 3:
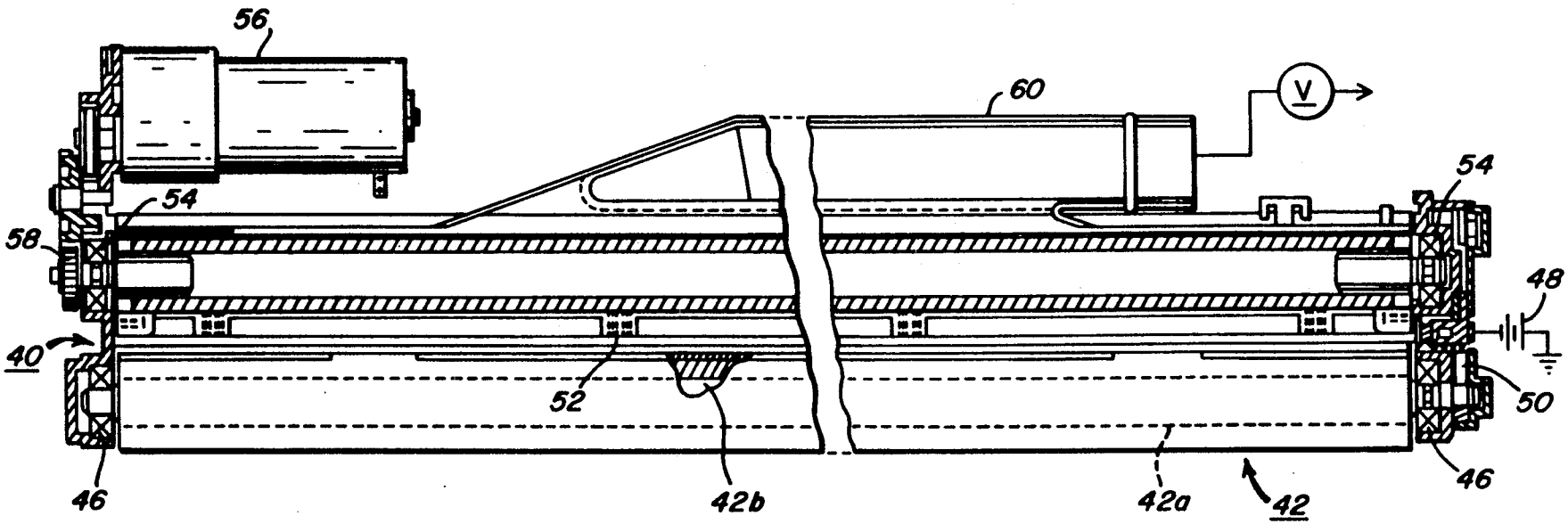
FIG. 3 is a side elevational view, partly in cross-section and with portions removed, of the roller transfer assembly taken along lines 3—3 of FIG. 2.

Turning now to the roller transfer assembly according to this invention, the assembly, designated generally by the numeral 20, is best shown in FIGS. 2–4. The roller transfer assembly 20 includes a unitary housing 40 containing a transfer roller 42, a roller cleaning mechanism 44, and a detack mechanism 24 in a compact configuration. The transfer roller 42 comprises a steel core **42*a* having a urethane overcoat 42*b*. The diameter of the roller 42 is selected so as to relatively small, on the order of 2.5 cm for example, whereby the transfer field induced by the roller simulates a field created by a corona charger. Since the overall resistivity of the transfer roller 42 is effected by environmental conditions (temperature and humidity within the reproduction apparatus), the electrical bias applied to the core 42*a* of the roller is from a voltage limited constant current power supply 48 through a rod 50. With the transfer roller 42 in operative association with the dielectric support 12** (i.e., nip relation), the ionization current is divided between the pre-nip and post-nip regions. Under normal operating conditions, virtually all of the ionization occurs in the post-nip region for effective transfer of the marking particle developed image from the dielectric support to the receiver member. A small amount of pre-nip ionization can be tolerated but must be regulated to prevent image transfer defects. Accordingly, the transfer electrical bias is held below $-6.0$ kV for a nominal current of 40 ua, roller resistivity of less than $7.0\times10^9$ o-cm, and a constant current power supply voltage limit of $-5.5$ kV to $-6.0$ kV.

End bearings 46 in the housing 40 (see FIG. 3) support the transfer roller 42 in the housing for free rotation. As such, when the transfer roller is in operative association with the dielectric support 12 (see FIG. 2) as will be fully described hereinbelow, an electrical transfer field is established which will efficiently transfer a marking particle developed image from the dielectric support to a receiver member passing therebetween. Further, due to the free rotational mounting of the transfer roller in the housing, the movement of the dielectric support 12 causes the transfer roller to rotate about its longitudinal axis. Such action (along with the relatively small diameter of the transfer roller) provides several benefits: it establishes uniform intimate contact between the receiver member and the dielectric support to substantially prevent image defects, it prevents the transfer roller from imparting tracking error into the moving dielectric support, and it prevents undue wear of the dielectric support by the roller.

When the transfer roller 42 contacts the dielectric support 12 with no receiver member therebetween, the transfer roller tends to pick up residual marking particles from the dielectric support. On subsequent passes of receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 according to this invention includes an elongated, cylindrical, fiber brush 52. The brush 52 is supported in the unitary housing 40 in bearings 54 such that the longitudinal axis of the brush is parallel to the longitudinal axis of the transfer roller 42. Additionally the respective longitudinal axes are spaced apart a distance such that a portion of the peripheral surface of the brush 52 contacts the transfer roller 42. A motor 56, attached to the unitary housing 40, is coupled via a gear train 58 to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

Additionally, the cleaning mechanism 44 includes a skive blade 60 to help mechanically free marking particles from the transfer roller 42. The skive blade 60, formed from a thin sheet of shim stock steel, is secured to the unitary housing 40 and extends therefrom as a cantilevered beam so as to contact the transfer roller at a blade angle in the range of between about 10° and 15° adjacent to the area of contact between the transfer roller and the brush 52. As such, marking particles loosened from the surface of the transfer roller are swept up by the brush into the brush fibers.

Figure 5:
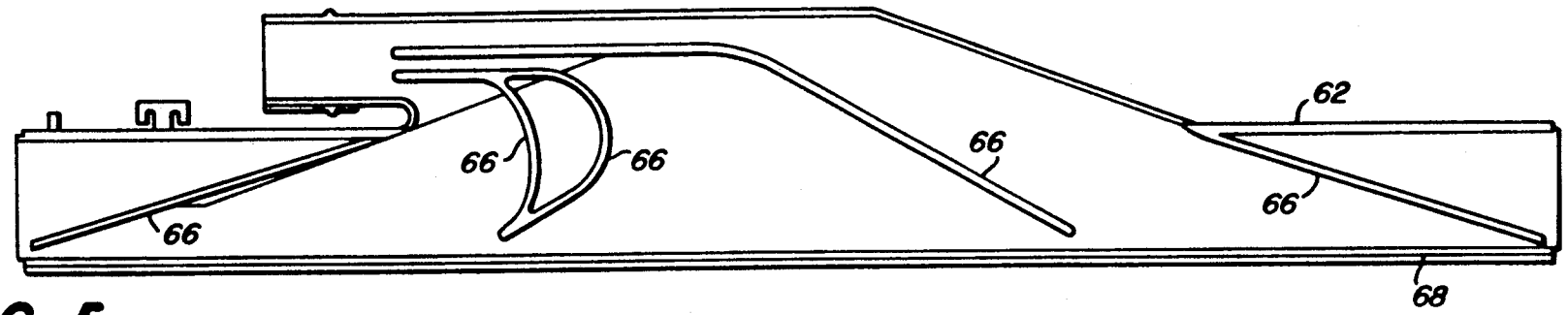
FIGS. 5, 6, and 7 are side elevational views of respective segments of the cleaning mechanism wall structure for the roller transfer assembly according to this invention.
Figure 6:
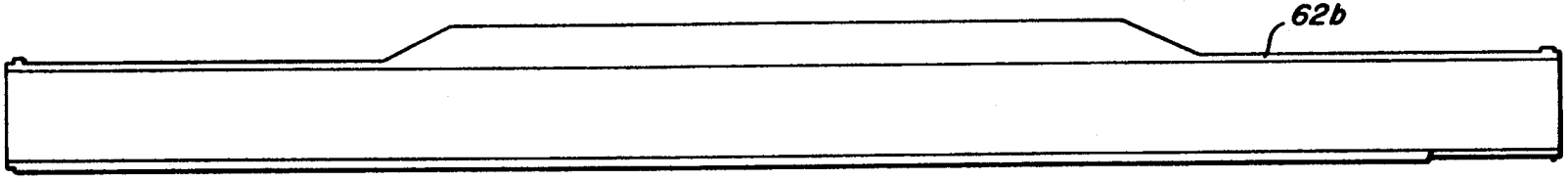
Figure 7:
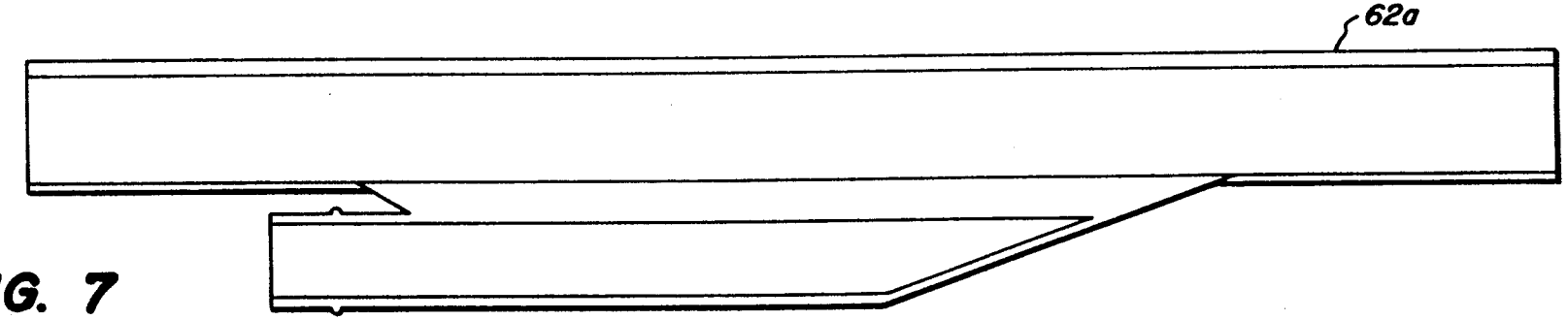
Figure 8:
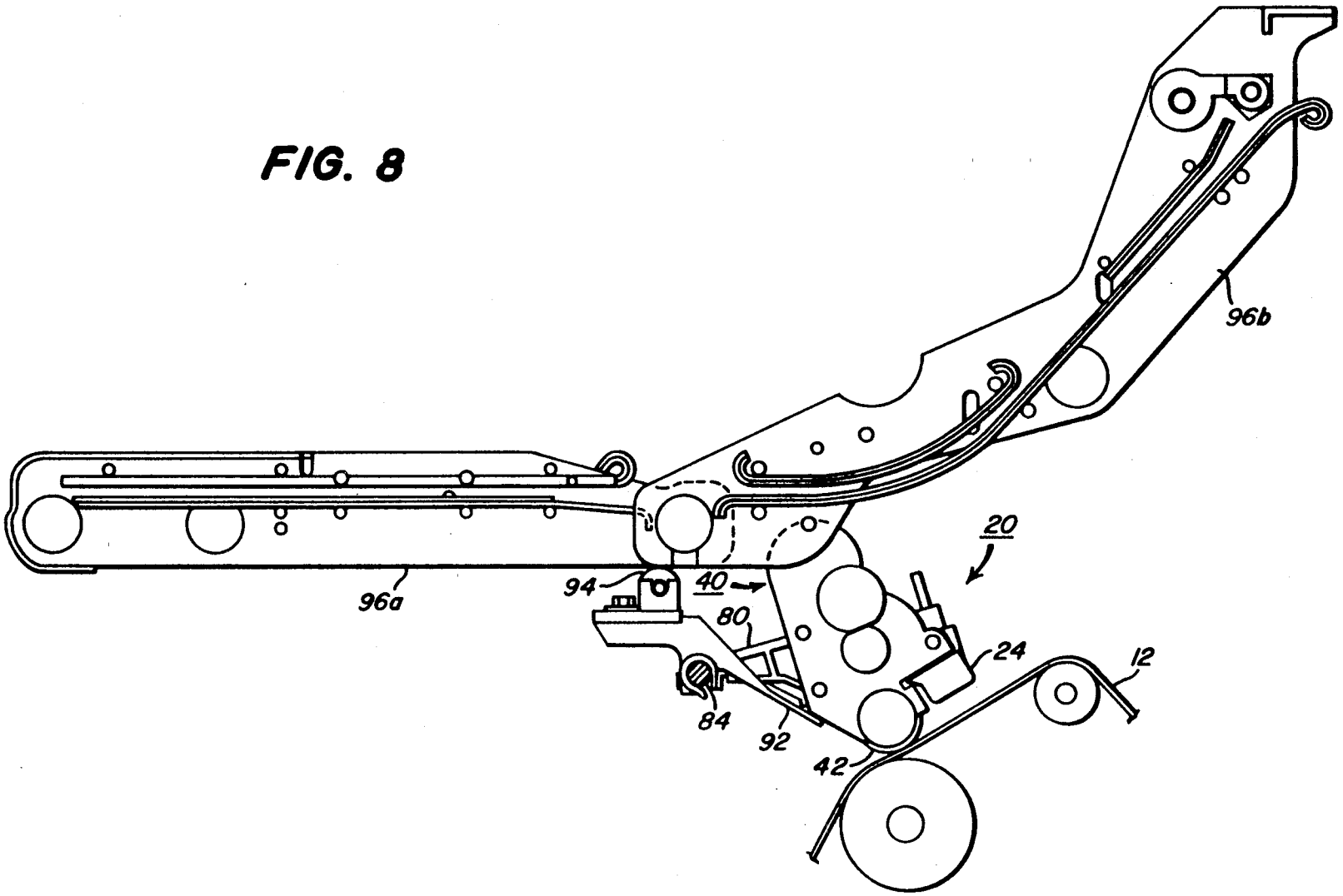
FIG. 8 is a front elevational view, similar to FIG. 2, of the roller transfer assembly according to this invention in its operative position in the reproduction apparatus.

In order to keep the fibers of the brush 52 from becoming overloaded with marking particles cleaned from the transfer roller 42, the cleaning mechanism 44 also includes a vacuum air flow system 62. The vacuum air flow system 62 is a three-part arrangement, in flow communication with a vacuum blower V (see FIG. 3), which act as walls to form an air flow directing chamber about the brush 52 in the longitudinal direction. The parts **62*a*, 62*b*, and 62*c* of the air flow system, shown assembled together in FIG. 2 and as separate elements in FIGS. 5, 6, and 7 respectively, are formed of a nonconductive material (as is the unitary housing 40**) to prevent static charge build up.

On assembly, parts **62*a* and 62*b* of the vacuum air flow system 62 closely fit about a substantial portion of the peripheral surface of the brush 52 not in contact with the transfer roller 42. Parts 62*b* and 62*c* in turn cooperate to form an air flow passage wrapping about a portion of of the brush 52 with an opening 64 to the brush located adjacent to the peripheral surface of the brush downstream (in the direction of rotation of the brush) from the area of contact between the brush and the transfer roller and extending in the direction of the longitudinal axis of the brush. Part 62*c* includes a plurality of internal ribs 66 which, on mating assembly of the parts of the vacuum air flow system 62, engage part 62***b*. The ribs 66 form air flow guides to direct the air flow between the parts 62*b* and 62*c* in such a way as to provide uniform air flow distribution along the longitudinal axis of the brush 52. Further, part 62*c* has a lip 68 which extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The detack mechanism 24 of the roller transfer assembly 20 is preferably an AC corona charger. A housing 70 for the charger is interconnected with the unitary housing 40 (see FIGS. 2 and 4). The housing 70 is located such that when the roller transfer assembly 20 is in operative association with the dielectric support 12, the charger is located downstream (in the direction of dielectric support travel) from the transfer roller 42 to effectively provide a field which relieves the electrostatic attraction forces between the receiver member and the dielectric support. In this manner, the receiver member is readily detacked from the dielectric support for transport along its intended path P to the fusing device 28 (FIG. 1) without interference or jamming.

The housing 70 of the charger includes an electrical connector 72 adjacent to one end thereof to enable connection to an electrical power source (not shown). Further, the housing 70 has a vent hood 74 located at approximately the mid-point thereof. The vent hood 74 has an opening in flow communication with the interior of the charger housing, and is connected through a coupling 76 to a vacuum blower (not shown). By such arrangement, any noxious fumes (such as ozone, for example) generated by the charger may be safely removed to a remote location for treatment prior to entering the environment surrounding the reproduction apparatus 10.

Figure 9:
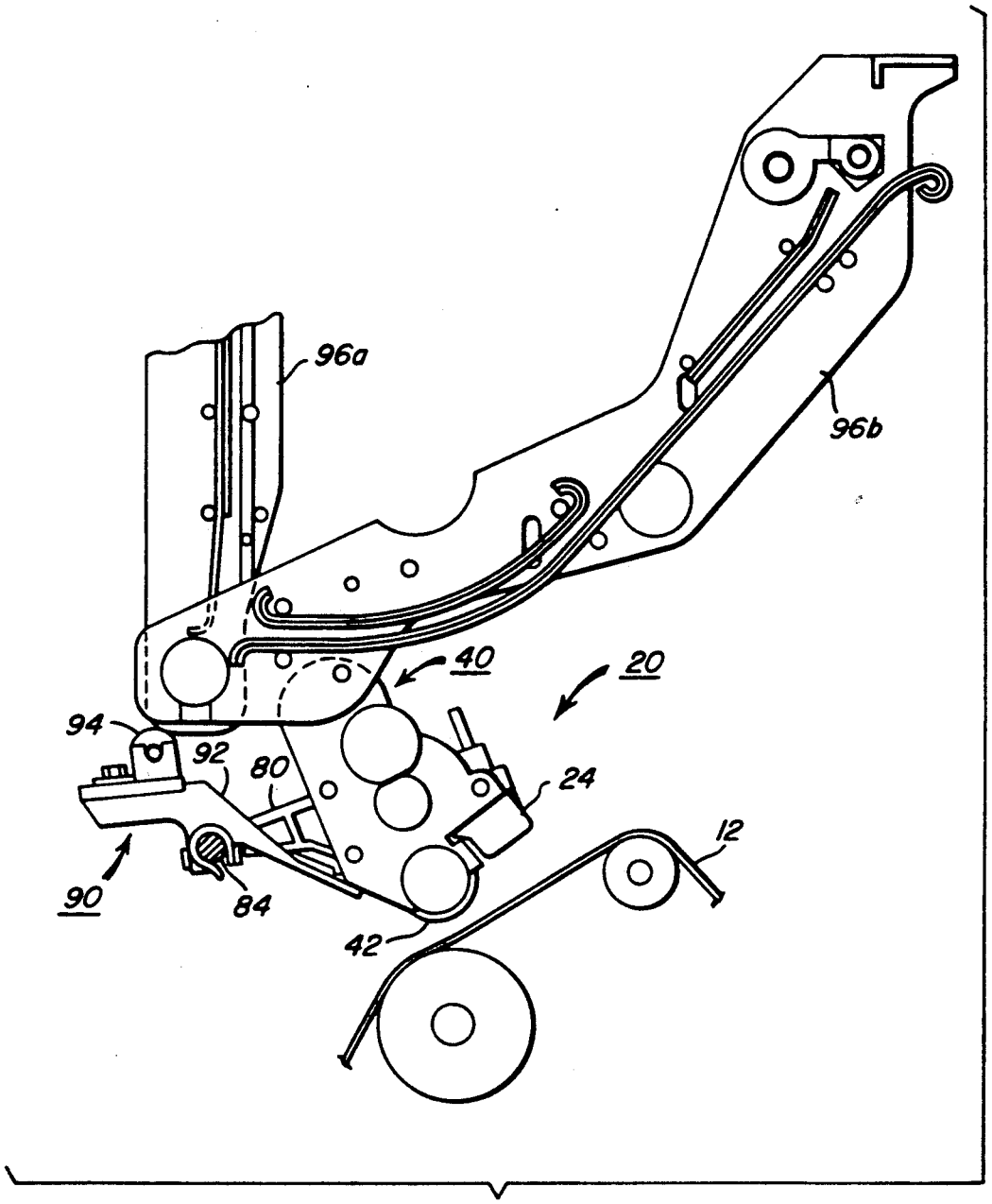
FIGS. 9 and 10 are front elevational views, similar to FIG. 8, of the roller transfer assembly in its inoperative position in the reproduction apparatus.
Figure 10:
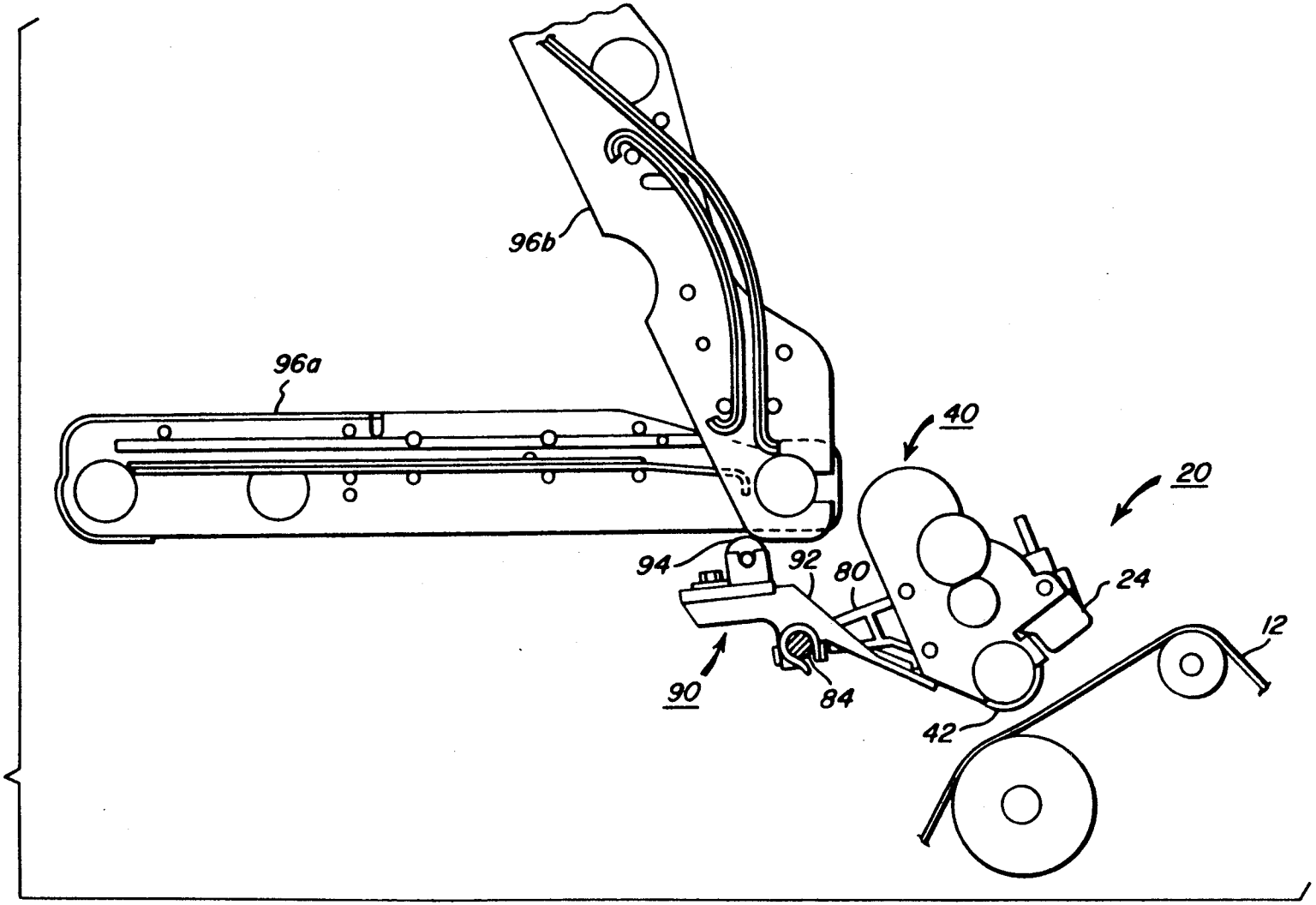

With the compact arrangement for the roller transfer assembly 20 described above, a further aspect of this invention is to enable the assembly to be readily moved from its position in operative association with the dielectric support 12 (see FIGS. 2 and 8) to a position remote from the dielectric support (see FIGS. 9 and 10). Accordingly, as best shown in FIGS. 2 and 8–10, the unitary housing 40 of the roller transfer assembly 20 includes longitudinally spaced arms 80 (only one shown in the drawings) extending outwardly therefrom. Each of the arms has a bearing portion 82, at the end opposite the unitary housing 40, mounted for free pivotable movement about a pivot shaft 84. In its normal position, the roller transfer assembly 20 is urged by gravitational forces about the pivot shaft 84 such that the transfer roller 42 of the assembly rests on the dielectric support 12 in operative association therewith. The weight of the roller transfer assembly 20 is sufficient to maintain the transfer roller 42 in engagement with the dielectric support to rotate the transfer roller in its bearing support 46 within the unitary housing 40 to thereby provide effective pressure on a receiver member passing between the transfer roller and the dielectric member. As such a marking particle developed image on the dielectric support 12 is efficiently transferred to the receiver member in a manner which substantially prevents any undesirable image defects.

In order to move the roller transfer assembly 20 to its remote position relative to the dielectric support 12, a lifting mechanism 90 is provided. The lifting mechanism 90 includes at least one elongated crank 92 freely supported on the pivot shaft 84 at approximately the mid-point of the crank. One end of the crank 92 has a lifting surface 92*a* which engages a mating surface 40*a* of the unitary housing 40. The opposite end of the crank 92 has a follower assembly 94 in the form, for example, of a rotatable roller mounted in a bearing support on the crank. The dimension of the crank 92 is selected such that the follower assembly 94 is located in juxtaposition with a portion of the structure 96 of the reproduction apparatus 10 forming cooperative segments 96*a*, 96*b* of a portion of the receiver member transport path. The segments 96*a*, 96*b*, in their normal path defining positions (FIG. 8), enable the crank 92 of the lifting mechanism 90 to be located so as not to interfere with the location of the roller transfer assembly 20 in operative association with the dielectric support 12. On the other hand, when either segment 96*a* or 96*b* is moved to its position out of the receiver member transport path defining position (see FIGS. 9 and 10 respectively), such segment will engage the follower assembly 94 and rotate the crank 92 of the lifting mechanism 90 about the pivot shaft 84 in a direction which causes the surface 92*a* to interact with the surface 40*a* of the unitary housing 40 to lift the roller transfer assembly 20 to its remote position. The roller transfer assembly 20 is thus spaced from the dielectric support a distance sufficient to enable ready removal of any jammed receiver member. Additionally, the dielectric support 12 is free to be changed without any potential damaging interference from the roller transfer assembly 20.

The invention has been described in detail with particular reference to preferred embodiments thereof, but it will be understood that variations and modifications can be effected within the spirit and scope of the invention.

We claim:

1. For use in an electrostatographic reproduction apparatus, a roller transfer assembly of compact configuration for effecting transfer of a pigmented marking particle image from a dielectric support to a receiver member, said roller transfer assembly comprising:

an electrically biased transfer roller;

means for cleaning said transfer roller;

detack means for facilitating release of said receiver member from said dielectric support;

a unitary housing including means for supporting said transfer roller for free rotation about its longitudinal axis, means for supporting said cleaning means in operative association with said transfer roller, and means for supporting said detack means;

means for supporting said unitary housing for movement to a first position in operative association with said dielectric support and a second inoperative position remote from said dielectric support; and means for selectively moving said unitary housing to said first position or to said second position, said moving means including an elongated lift member engageable with said unitary housing during jam clearance for automatically moving said unitary housing from its first position to its second position.

2. The invention of claim 1 wherein said cleaning means includes an elongated substantially cylindrical brush located such that its longitudinal axis is substantially parallel to the longitudinal axis of said transfer roller and spaced therefrom a distance such that a portion of the periphery of said brush engages said transfer roller, and means for rotating said brush about its longitudinal axis.

3. The invention of claim 2 wherein said means for rotating said cleaning brush includes a motor operatively coupled to said brush to rotate said brush in a direction such that the peripheral portion of said brush in contact with said transfer roller moves relative to said roller.

4. The invention of claim 2 wherein said cleaning means further includes a wall surrounding a major portion of the periphery of said brush not in contact with said transfer roller to form a chamber thereabout, and means for producing an air flow within said chamber to remove marking particles, cleaned from said transfer roller by said brush, from said brush.

5. The invention of claim 4 wherein said wall has a plurality of internal ribs located to provide uniform air flow within said chamber.

6. The invention of claim 4 wherein said cleaning means further includes a skive member contacting the periphery of said transfer roller to facilitate removal of marking particles from the surface thereof.

7. The invention of claim 1 wherein said means for supporting said unitary housing includes a pivot shaft having its longitudinal axis located substantially parallel to the longitudinal axis of said transfer roller, and a hanger arm connected at one end to said unitary housing and supported at its opposite end for free rotation about said pivot shaft, whereby said unitary housing is normally located in its first position.

8. The invention of claim 7 wherein said means for selectively moving said unitary housing includes an elongated lift member engageable with said unitary housing during jam clearance for automatically moving said unitary housing from its first position to its second position.

9. The invention of claim 8 wherein said elongated lift member is mounted on said pivot shaft.

10. The invention of claim 8 wherein said elongated lift member is mounted intermediate its ends on said pivot shaft, and the end of said lift member opposite its engagement with said unitary housing includes a cam follower mechanism adapted to be engaged by a portion of said electrostatographic apparatus on jam clearance.

11. The invention of claim 10 wherein said cam follower mechanism is a roller, and the portion of said electrostatographic reproduction apparatus is a segment of the receiver sheet travel path thereof.

12. The invention of claim 1 wherein said detack means includes an AC corona charger.

13. The invention of claim 12 wherein said detack means further includes means for venting said AC corona charger whereby any ozone produced thereby is removed.

14. The invention of claim 1 wherein said transfer roller is of small diameter on the order of 2.5 cm.

15. The invention of claim 14 wherein the transfer roller has a resistivity of approximately less than $7\times10^9$ o-cm.

16. The invention of claim 15 wherein the electrical bias for said transfer roller is a voltage limited constant current power supply.

17. The invention of claim 16 wherein the voltage limit for said constant current power supply is on the order of about −5.5 kV to −6.0 kV.

18. In an electrostatographic reproduction apparatus, an improved transfer device for effecting transfer of a pigmented marking particle image from a dielectric support to a receiver member, said improvement comprising:

a unitary housing;

an electrically biased transfer roller supported in said unitary housing;

means for cleaning said transfer roller, said cleaning means including an elongated substantially cylindrical brush located such that its longitudinal axis is substantially parallel to the longitudinal axis of said transfer roller and spaced therefrom a distance such that a portion of the periphery of said brush engages said transfer roller, and means for rotating said brush about its longitudinal axis, a wall surrounding a major portion of the periphery of said brush not in contact with said transfer roller to form a chamber thereabout, and means for producing an air flow within said chamber to remove marking particles, cleaned from said transfer roller by said brush, from said brush, said wall having a plurality of internal ribs located to provide uniform air flow within said chamber;

detack means for facilitating release of said receiver member from said dielectric support mounted in said unitary housing;

means for supporting said unitary housing for movement to a first position in operative association with said dielectric support and a second inoperative position remote from said dielectric support; and means for selectively moving said unitary housing to said first position or to said second position.

19. The invention of claim 18 wherein said cleaning means further includes a skive member contacting the periphery of said transfer roller to facilitate removal of marking particles from the surface thereof.

20. The invention of claim 18 wherein said means for supporting said unitary housing includes a pivot shaft having its longitudinal axis located substantially parallel to the longitudinal axis of said transfer roller, and a hanger arm connected at one end to said unitary housing and supported at its opposite end for free rotation about said pivot shaft, whereby said unitary housing is normally located in its first position.

21. The invention of claim 20 wherein said means for selectively moving said unitary housing includes an elongated lift member mounted on said pivot shaft engageable with said unitary housing during jam clearance for automatically moving said unitary housing from its first position to its second position.

22. The invention of claim 18 wherein said detack means includes an AC corona charger.

23. The invention of claim 22 wherein said detack means further includes means for venting said AC corona charger whereby any ozone produced thereby is removed.

24. The invention of claim 18 wherein said transfer roller is of small diameter on the order of 2.5 cm.

25. The invention of claim 24 wherein the transfer roller has a resistivity of approximately less than $7\times10^9$ o-cm.

26. The invention of claim 25 wherein the electrical bias for said transfer roller is a voltage limited constant current power supply.

27. The invention of claim 26 wherein the voltage limit for said constant current power supply is on the order of about −5.5 kV to −6.0 kV.

* * * * *